US006450426B1

(12) United States Patent
Lee

(10) Patent No.: US 6,450,426 B1
(45) Date of Patent: Sep. 17, 2002

(54) ICE PLANER

(76) Inventor: Ming-Tsung Lee, P.O. Box 90, Tainan City (TW)

( * ) Notice: Subject to any disclaimer, the term of this patent is extended or adjusted under 35 U.S.C. 154(b) by 3 days.

(21) Appl. No.: 09/761,675

(22) Filed: Jan. 18, 2001

(51) Int. Cl.[7] ..... A01F 21/00
(52) U.S. Cl. ..... 241/37.5; 241/92; 241/DIG. 17
(58) Field of Search ..... 241/92, 285.1, 241/37.5, DIG. 17

(56) References Cited

U.S. PATENT DOCUMENTS 5,007,591 A * 4/1991 Daniels, Jr. ..... 241/169.1
6,012,660 A * 1/2000 Colman ..... 241/100

* cited by examiner

*Primary Examiner*—Mark Rosenbaum

(57) ABSTRACT

An ice planer includes a base, a fix frame, a cylinder, a body, a safety hook, a transmit device and a push cap. When the body is fitted with the cylinder, the safety hook rests against the inner wall of the cylinder and its upper end separate from the touch switch, and a planing plate under the body presses down ice blocks in the cylinder and pushes up the transmit shaft of the transmit device, with the touch switch moved up. Then the push cap is pressed to touch the touch switch to turn on the transmit device to operate the ice planer. Thus, the ice planer has three separate safety measures to let its use very safe, and in addition, the transmit device is contained in the body, not to get wet to increase its service life, with the components easily assembled and disassembled.

5 Claims, 6 Drawing Sheets

ICE PLANER

BACKGROUND OF THE INVENTION

1. Field of the Invention

This invention relates to an ice planer, particularly to one safe to use through three separate control measures and a transmit device protected from getting wet in planing ice, prolonging its service life with the components easy to assemble and disassemble for washing.

2. Description of the Prior Art

Conventional ice planers seen on market generally do not have safety components to involve potential danger of getting hurt due to carelessness. In addition, they are generally heavy and difficult to assemble or disassemble, and a motor may be wetted in washing the whole ice planer, often get short-circuited to shorten service life.

SUMMARY OF THE INVENTION

The objective of the invention is to offer an ice planer very safe to use by means of three separate control measures.

One feature of the invention is a transmit device positioned in a body to prevent it from getting wet so as to increase its usable life.

Another feature of the invention is components easy to assemble and disassemble in case of washing it.

BRIEF DESCRIPTION OF THE INVENTION

This invention will be better understood by referring to the accompanying drawings, wherein.

DETAILED DESCRIPTION OF THE PREFERRED EMBODIMENT

Figure 1:
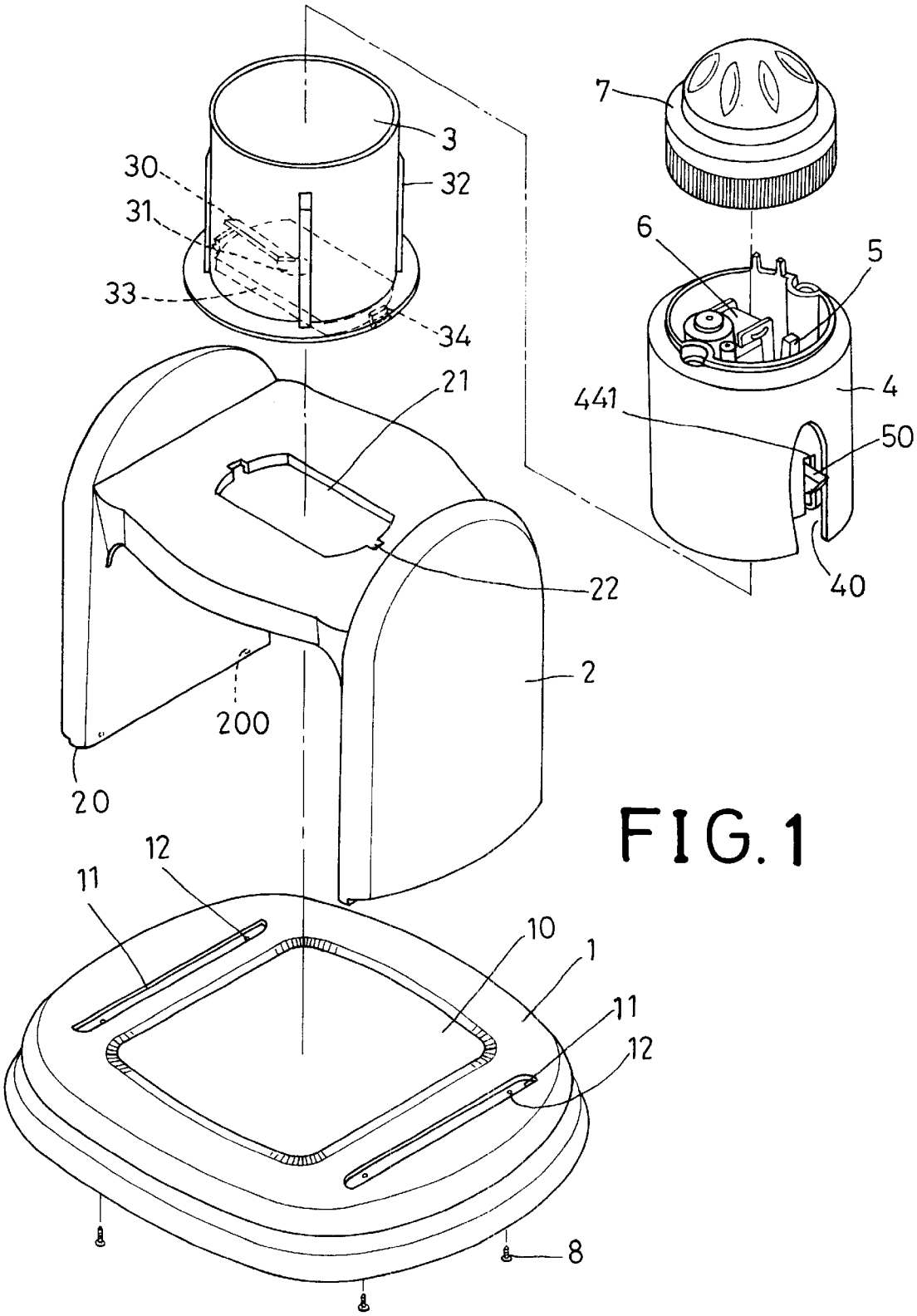
FIG. 1 is an exploded perspective view of an ice planer in the present invention.
Figure 2:
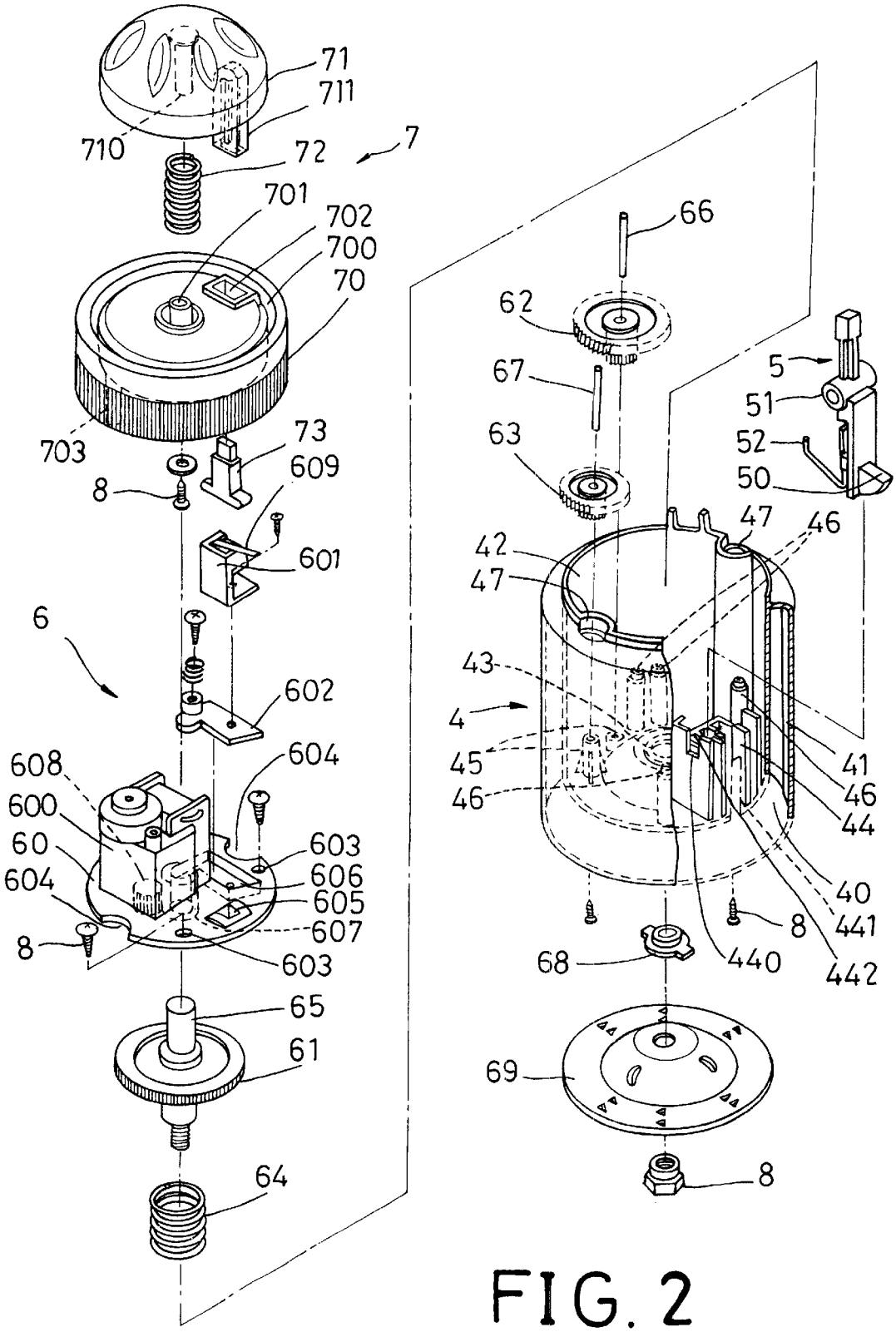
FIG. 2 is an exploded perspective view of a body, a transmit device, a safety hook, and a push cap in the present invention.
Figure 3:
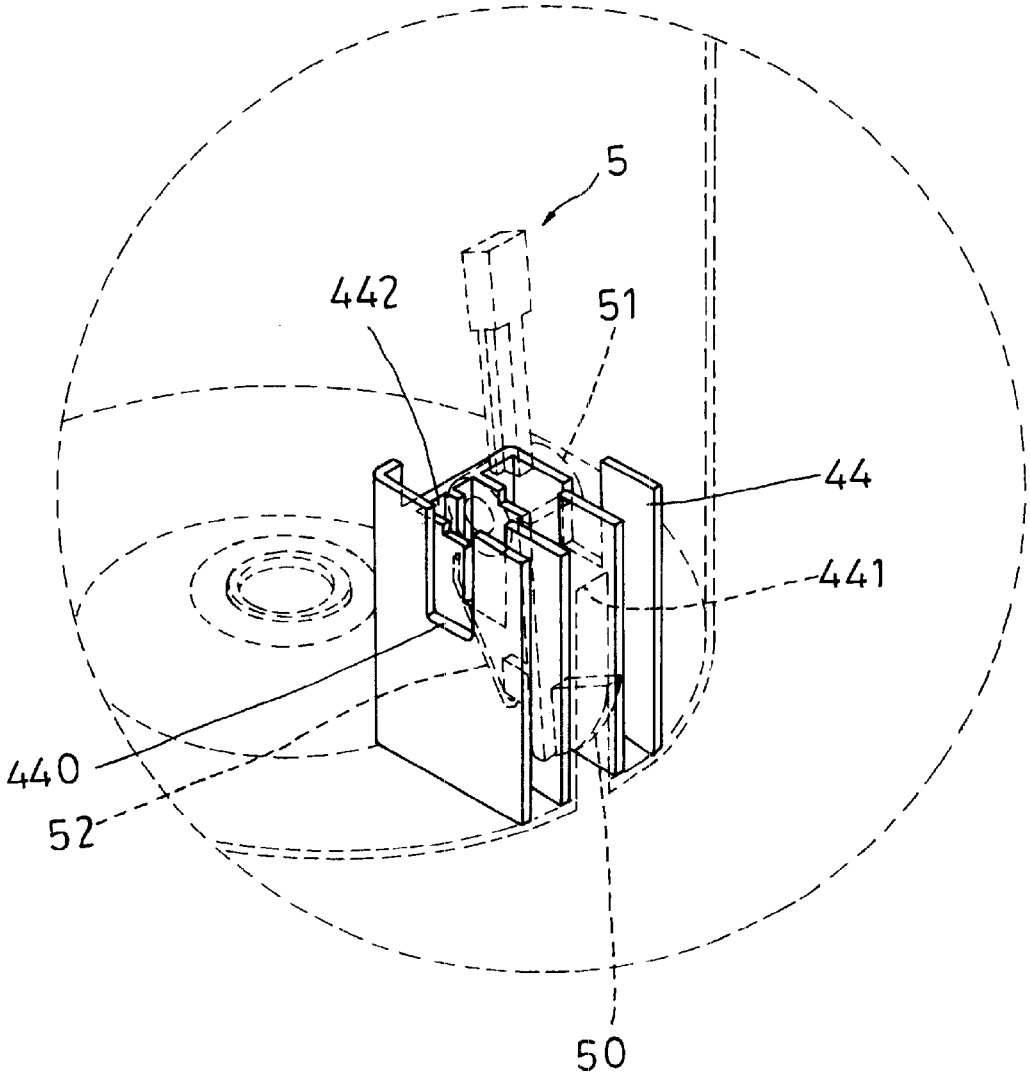
FIG. 3 is a magnified cross-sectional view of the safety hook combined with a hook base in the present invention.
Figure 4:
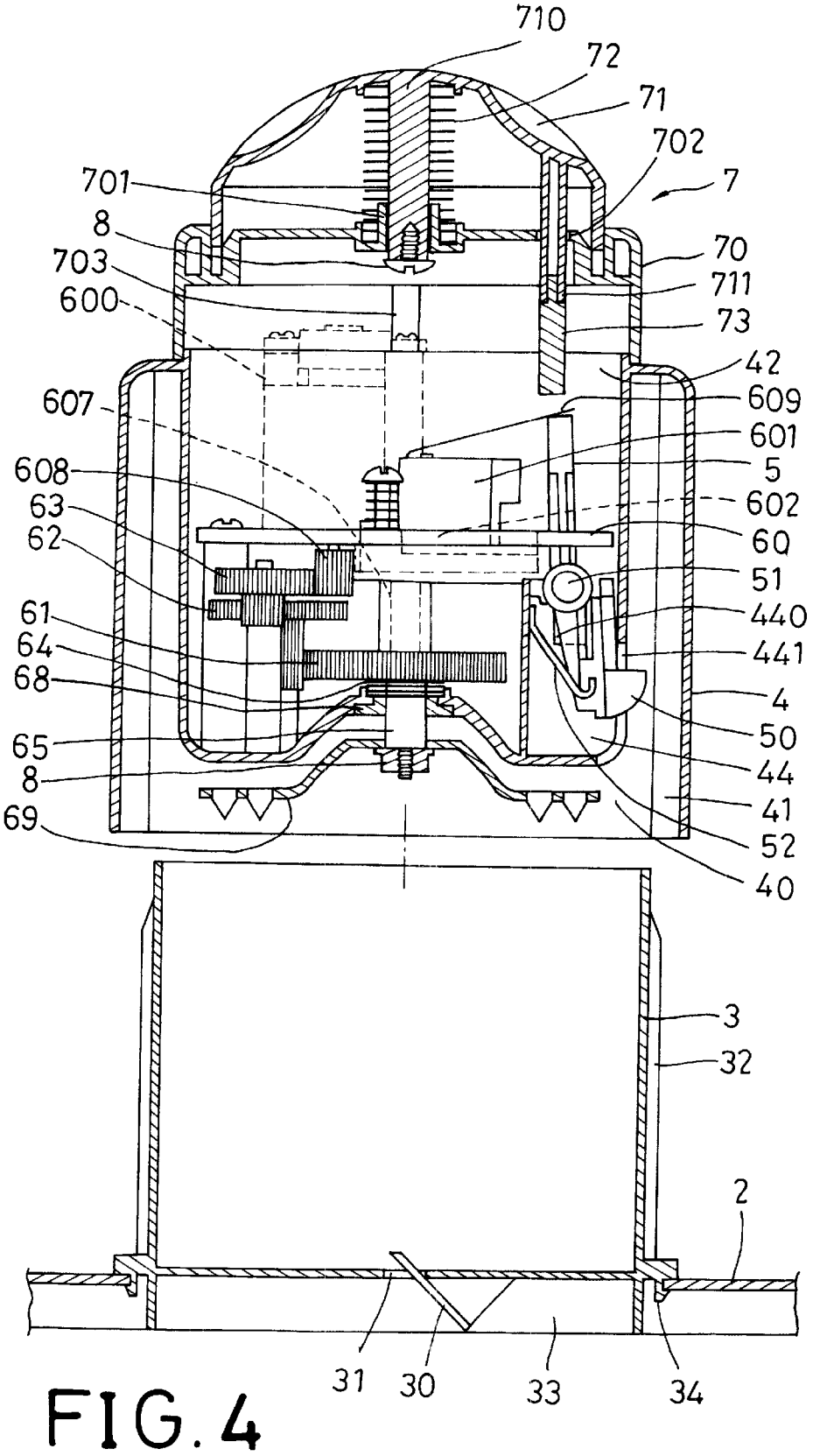
FIG. 4 is a cross-sectional view of the body not yet fitted with a cylinder in the present invention.
Figure 5:
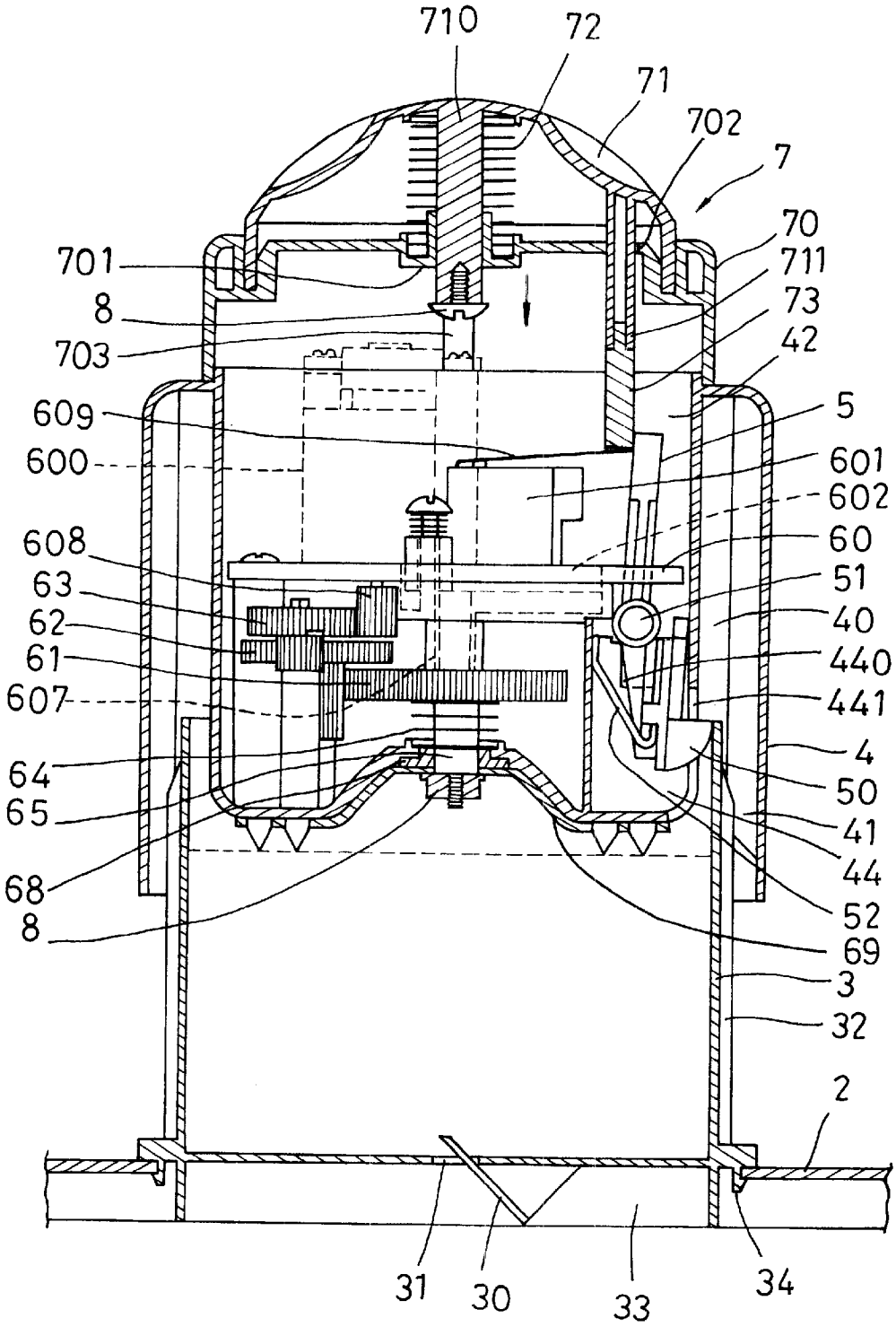
FIG. 5 is a cross-sectional view of the body fitted with the cylinder in the present invention; and, FIG. 6 is a perspective view of the ice planer in the present invention.
Figure 6:
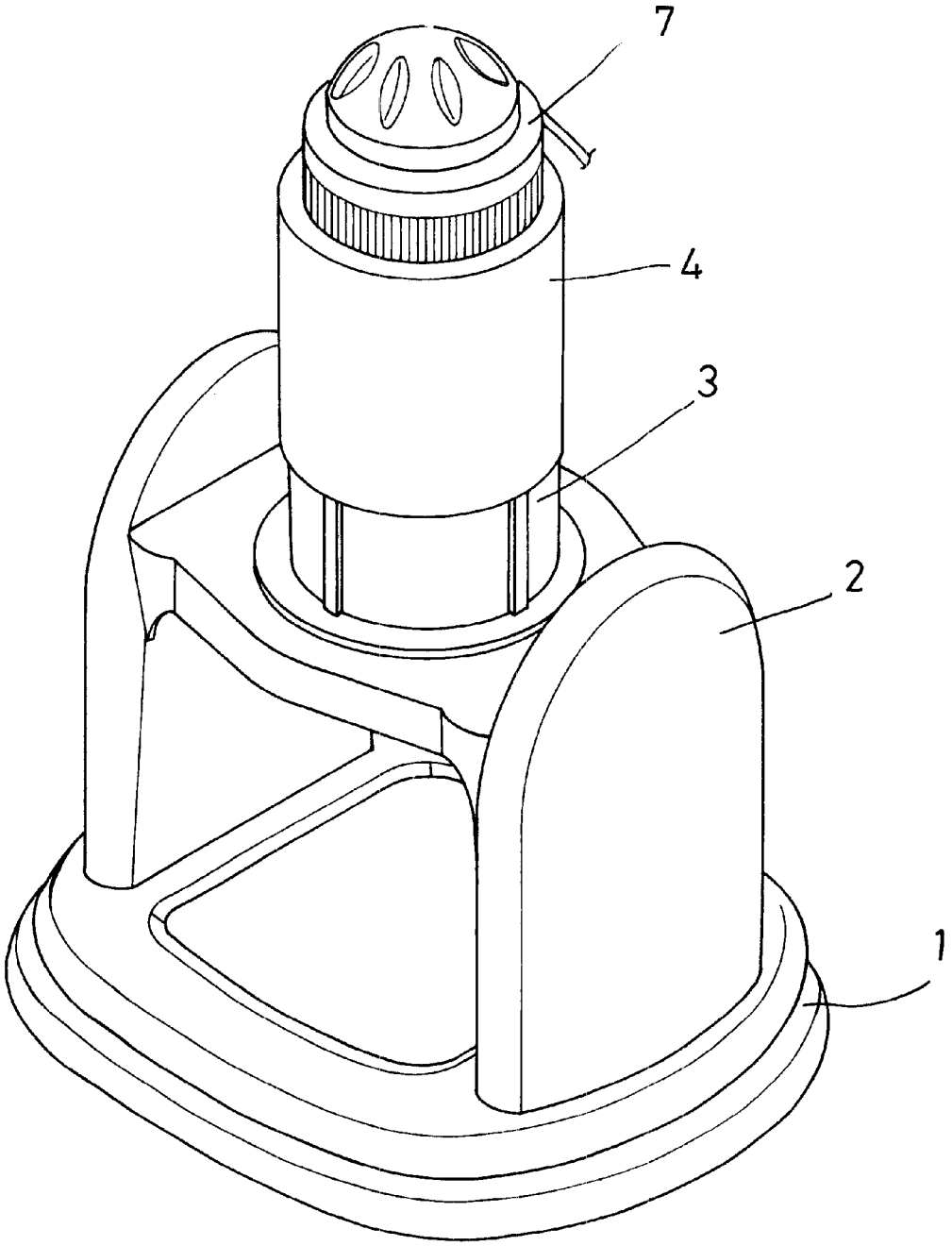

A preferred embodiment of an ice planer in the present invention, as shown in FIGS. 1, 2 and 3, includes a base 1, a fix frame 2, a cylinder 3, a body 4, a safety hook 5, a transmit device 5, and a push cap 7 as main components combined together.

The case 1 has a recess 10 formed in an upper surface for placing a dish thereon, an elongate position groove 11 respectively provided in two opposite sides, and plural holes 12 bored in each position groove 11.

The fix frame 2 is shaped as an inverted U, combined on the base 1, having a projection 20 formed respectively in a bottom of two elongate opposite sides to engage the two position grooves 11, a threaded hole 200 formed respectively in a center lower end of the two opposite side walls, and an opening 21 formed in an upper horizontal wall and having two engage notches 22 formed in two opposite side edges.

The cylinder 3 is combined on the fix frame 2, having a plane blade 30 and a drop hole 31 in the bottom, a plurality of vertical projecting strips 32 fixed spaced apart equidistantly on an outer surface, a combine member 33 formed to protrude in the bottom and having the same size and shape as the opening 21 of the fix frame 2, and a hook 34 fixed at two sides of the combine member 33 to hook the engage notches 22.

The body 4 is fitted with the cylinder 3, having a chamber 42 formed in its interior, an annular hollow 40 defined by an annular wall of the chamber 42 and an outer wall of the body 4, plural vertical strips fixed spaced apart equidistantly on an inner wall defining the annular hollow 40, a shaft hole 43 bored in the bottom center of the chamber 42, a hook base 44 provided to connect to one side wall of the chamber and having an engage aperture 440 respectively in an intermediate portion of two sides, a long vertical hook hole 441 formed between the hook base 44 and the chamber 42 and extending up from the bottom, a stop groove 442 formed in the hook base 44 facing the hook hole 441. The chamber 42 has plural insert holes 45 formed in proper locations for combining a medium gear 62, a small gear 63 and two auxiliary shafts 66, 67 of the transmit device 6, and plural posts 46 in its interior on the bottom. Further, two opposite combine holes 47 are provided in an upper end of the annular hollow 40.

The safety hook 5 is combined in the hook base 44 of the body 4, having a hook 50 protruding out of a lower end to engage the hook hole 441 of the hook base 44, a lateral tubular rod 51 formed in an intermediate portion to fit in the engage groove 440 of the hook base 44, and an elastic member 52 fixed to extend inward from the bottom to fit in the stop groove 442 of the hook base 44.

The transmit device 6 is positioned in the body 4, having a motor base 60 shaped like a round disc, a motor 600, a touch switch 601 and a support push plate 602 located on the motor base 60, plural holes 603 bored around the motor base 60, two concave notches 604 formed oppositely in an outer edge of the motor base 60, a square hole 605 near the outer edge of the motor base 60, and a groove 606 formed in a lower portion of the motor 600 and having the same shape of the support push plate 602 to receive the same support push plate 602 therein. The touch switch 601 is fixed on the support push plate 602, having a touch strip 609 on an upper portion, a shaft hole 607 bored in the center of the motor base 60 and covered on by a projecting plate of the support push plate 602. Further, the motor 600 has its spindle fitting firmly through a gear 608 and protruding out of the bottom of the motor base 60. In addition, the transmit device 6 includes a large, a medium and a small gear 61, 62, and 63, a coil spring 64, transmit shaft 65, an auxiliary shafts 66, 67, and a position gasket 68 and a planing plate 69 combined under the bottom of the body 4.

The push cap 7 closes on the upper side of the body 4, facing the transmit device 6, having a cap base 70 and an upper cap 71 screwed with the cap base 70. The cap base 70 is provided with an annular groove 700 on an upper surface and a center protruding-up shaft tube 701, a rectangular through hole 702 formed in one side, and two opposite threaded holes 703 formed in two opposite sides to align to the combine holes 47 of the body 7. The upper cap 71 engages with the annular groove 700 of the cap base 70, having a pivot 710 extending vertically down from an inner center surface to screw with the shaft tube 701, an insert rod 711 vertically extending down from an inner surface beside the pivot 710 out of the hole 702 of the cap base 70 with a coil spring 72 fitting around pivot 710. Further, a push member 73 extends upward from under the cap base 70 to insert firmly in the insert rod 711. Those components are screwed together with a screw 8.

In assembling, referring to FIGS. 1, 4, 5, and 6, firstly the two projections 20 of the fix frame 2 are fitted in the two elongate position grooves 11 of the base 1, letting the threaded holes 200 of the fix frame 2 screw with the screws 8. Next, the cylinder 3 is combined with the fix frame 2 by engaging the combine member 33 and the two hooks 34 respectively with the opening 21 and the two engage notches 22. Then the safety hook 5 is deposited in the hook base 44 of the body 4, with the hook 50 hooking the hooking hole 441 of the hook base 44, with the elastic member 52 fitting in the stop groove 442, and with the round rod 51 engaging an upper edge of the engage groove 440. Further, the position gasket 68 of the transmit device 6 is fitted in the shaft hole 43 of the body 4, and the transmit shaft 65 is inserted in the coil spring 64, passing through the shaft hole 43 and the position gasket 68 and the planing plate 69 to screw with the screw 8 to secure the transmit shaft 65. After that, the auxiliary shafts 66, 67 are inserted in the insert groove 45 in the chamber 42 of the body 4, letting the medium gear 62 respectively engage the large gear 61 and the small gear 53. Then gear 608 extending down the motor base 60 engages the small gear 63. The upper end of the transmit shaft 65 passes through the shaft hole 607 of the motor base 60 to push the support push plate 602, and at the same time the upper portion of the safety hook 5 extends up through the through hole 605 of the motor base 60 to face the touch strip 609 of the touch switch 601. Next, after the coil spring 72 is fitted around the pivot 710 of the upper cap 71, the pivot 710 passes through the tubular shaft 701, with the upper cap 71 having its lower end engage the annular groove 700 of the cap base 70, and with the insert rod 711 extending through the through hole 702 and fitting firmly with the push member 73. Lastly the screws 8 screw with the threaded hole of the pivot 710 to combine together the upper cap 71 with the cap base 70 to form the push cap 7. When the push cap 7 is closed on the body 4, the threaded holes 703 of the cap base 70 are aligned and screwed together with the combine holes 47 of the body 4, permitting the push member 73 facing the touch switch 601 of the transmit device 6, finishing assembly of the ice planer in the invention.

In using, referring to FIGS., 1, 4, 5, at first, place a dish on the recess 10, and then an ice block in the cylinder 3, combine the body 4 on the cylinder 3 by fitting the annular wall of the cylinder 3 in the annular hollow 40. When the annular fit groove 40 fits with the annular wall of the cylinder 3, the projecting strips 32 of the cylinder 3 rests against the strips 41 of the annular fit groove 40 to secure the both components 3 and 4 together. So the cylinder 3 may not rotate together with the ice block rotating, and the safety hook 5 has the hook 50 protruding out of the engage groove 441 and stopped by the inner wall of the cylinder 3, letting the elastic member 52 pressed to force the round rod 51 rotate toward the wall of the chamber 42, and forcing the upper end of the safety hook 5 incline outward to separate from the touch strip 609 of the touch switch 601. At the same time, the planing plate 69 of the transit device 6 presses the ice blocks, which oppositely move up to further push up the transmit shaft 65 upward, with the upper end of the transmit shaft 65 push up the support push plate 602 of the motor base 60 and then the touch switch 601 up. At this moment press the push cap 7, forcing the upper cap 71 moving down the insert rod 711 and the push member 73 to press down the touch switch 601 to let the touch strip turn on the motor 600. Then the gear 608 of the motor base 60 rotates the small gear 63, the medium gear 62 and the large gear 61 orderly, subsequently rotating the ice block caught by the planing plate 68 by the transmit shaft 65, and the planing blade 30 of the cylinder 3 planes the ice blocks, and the planed ice bits drop down through the drop hole 31 on the dish. So its handling is very safe and convenient.

In case that the ice planer is to be washed, only pull up the body 4 containing the safety hook 5, the transmit device 76 and the push cap 7, and then separate the cylinder 3 from the fix frame by disengaging the engage hooks 34 from the engage notches 22. Thus the components of the ice planer are taken apart easily, ready for washing. In addition, the motor 600 and the touch switch 601, etc. are contained in the chamber 42, not touching water so as not to get wet, or get short-circuited to occur a fire, kept safe in use and prolonged in its service life.

As can be understood by the above description, there are three separate control measures provided in the ice planer in the invention, shown as follows.

1. The body 4 is fitted in the cylinder 3, with the safety hook 5 having its hook 50 rest against the inner wall of the cylinder 3, with the elastic member 52 pressed to rotate the round rod 51, and then the safety hook 5 can have its upper end separate from the touch strip of the touch switch 601.
2. In using, ice blocks have to be placed in the cylinder first, and then the planing plate 69 under the body 4 can press the ice blocks, and the transmit shaft 65 of the transmit device 6 can be pushed up the touch switch 601 to turn on the ice planer.
3. Then the push cap 7 has to be pressed to force the upper cap 71 move down compressing the coil spring 72 and the push member 73 touches the touch switch 601 to turn on the ice planer.

While the preferred embodiment of the invention has been described above, it will be recognized and understood that various modifications may be made therein and the appended claims are intended to cover all such modifications that may fall within the spirit and scope of the invention.

What is claimed is:

1. An ice planer comprising:

a base having a recess on an upper surface and a elongate position groove formed respectively at two opposite sides of said recess;

a fix frame shaped as an inverted U, screwed on said base, having an opening in a horizontal wall and two engage notches formed in two opposite sides of said opening;

a cylinder combined on said fix frame, able to contain ice blocks to be planed having a planing blade and a drop hole and a combine member protruding down in its bottom and two opposite hooks formed at two opposite sides of said combine member, said combine member engaging said opening of said fix frame, and said two opposite hooks engaging said two engage notches of said opening of said fix frame;

a body fitting with said cylinder, having an chamber in its interior, an annular empty fitting groove formed between an annular wall of said chamber and an outer wall, a transmit shaft hole bored in a proper location of a bottom, a hook base provided vertically along said annular wall of said chamber, an engage groove formed at a connect place of said hook base and said annular wall of said chamber;

a safety hook combined in said hook base of said body, having a hook in a bottom to hook a hook groove of said hook base and able to rest against an inner wall of said annular empty fitting groove of said body, and an elastic member to let said safety hook move leftward and rightward;

a transmit device contained in said body, consisting of a motor, a touch switch, a support push plate, and a motor base on which said motor, said touch switch and said support push plate are deposited, a transmit shaft protruding through said body and combined with said planing plate possible to be move up and down elastically, said touch switch having a touch strip facing to an upper end of said safety hook, and a gear unit;

a push cap closed on said body, having a cap base and an upper cap, said upper cap possible to be elastically pushed down, also having a push member combined at one side to face, touch and move said touch strip of said transmit device;

said hooks under said safety hook in said body resting against an inner wall of said cylinder to let an upper end separate from said touch switch when said body is fitted with said cylinder, said planing plate pressing ice blocks placed in said cylinder, said transmit shaft of said transmit device pushing said touch switch up at the same time, said upper cap of said push cap pushed down to let said push member under said push cap touch and push said touch switch to turn on said ice planer, said ice planer being very safe to use owing to three separate safety control measures, said transmit device contained in said body and protected from getting wet, prolonging service life of said ice planer, said components easy to assemble and disassemble for washing.

2. The ice planer as claimed in claim 1, wherein said cylinder has plural vertical projecting strips spaced apart equidistantly on an outer surface, and an annular insert groove of said body has plural vertical projecting strips spaced apart equidistantly on an inner wall to rest against said vertical strips of said cylinder so that said body may not rotate leftward or rightward after fitted with said cylinder.

3. The ice planer as claimed in claim 1, wherein said body has two opposite combine holes in an upper end of said annular fitting groove, and said cap base of said push cap has two threaded holes to align to and be screwed together with said two combine holes of said body to secure said cap base with said body.

4. The ice planer as claimed in claim 1, wherein said chamber in said body has plural insert grooves and plural posts in proper locations for auxiliary shafts of said transmit device to fit in and fix the position of said body and screw said motor base with said body.

5. The ice planer as claimed in claim 1, wherein said hook base of said body has stop grooves in side walls and engage apertures in intermediate portions for said safety hook to fit in and be secured stably therein.

* * * * *